US011325824B2

(12) United States Patent
Green

(10) Patent No.: US 11,325,824 B2
(45) Date of Patent: May 10, 2022

(54) DRAINABLE FUEL NOZZLE RECEPTACLE

(71) Applicant: Justin Green, Anchorage, AK (US)

(72) Inventor: Justin Green, Anchorage, AK (US)

( * ) Notice: Subject to any disclaimer, the term of this patent is extended or adjusted under 35 U.S.C. 154(b) by 0 days.

(21) Appl. No.: 17/214,867

(22) Filed: Mar. 28, 2021

(65) Prior Publication Data

US 2021/0362996 A1 Nov. 25, 2021

Related U.S. Application Data

(60) Provisional application No. 63/029,453, filed on May 23, 2020.

(51) Int. Cl.

| | |
|---|---|
| ***B67D 7/32*** | (2010.01) |
| ***B67D 7/04*** | (2010.01) |
| ***B67D 7/56*** | (2010.01) |
| ***B67D 7/42*** | (2010.01) |

(52) U.S. Cl.

CPC ..... *B67D 7/3209* (2013.01); *B67D 7/04* (2013.01); *B67D 7/42* (2013.01); *B67D 7/56* (2013.01)

(58) Field of Classification Search

CPC ... B67D 7/04; B67D 7/42; B67D 7/56; B67D 7/3209; B67D 7/421; B67D 7/845

USPC ..... 141/86, 331–345; 137/312–314

See application file for complete search history.

(56) References Cited

U.S. PATENT DOCUMENTS 3,774,654 A * 11/1973 Hjermstad ..... B60K 15/06 141/42
4,600,125 A * 7/1986 Maynard, Jr. ..... B67B 7/28 141/330
4,706,720 A * 11/1987 Pattison ..... B67C 11/00 141/327
4,883,229 A * 11/1989 Moeller ..... B67D 7/002 239/587.2
5,020,702 A * 6/1991 James ..... B67C 11/04 141/337
5,230,372 A * 7/1993 Westphal ..... B63B 11/04 114/343
5,349,995 A * 9/1994 Perez ..... B65F 3/00 141/330
5,447,245 A * 9/1995 Merhar ..... B65D 25/56 215/6
6,289,946 B1 * 9/2001 Davies ..... B60K 15/04 137/312
6,698,468 B1 * 3/2004 Thompson ..... B62J 35/00 141/331
6,732,770 B1 * 5/2004 Nusbaumer ..... B61K 11/00 137/615
7,089,976 B2 * 8/2006 Bargy ..... B60T 17/006 141/11

(Continued)

*Primary Examiner* — Timothy L Maust
(74) *Attorney, Agent, or Firm* — Baumgartner Patent Law; Marc Baumgartner

(57) ABSTRACT

A fuel nozzle receptacle for use with auxiliary fuel tanks is disclosed. A fuel nozzle is received in a receptacle or boot in a nozzle-down orientation that defines a secure storage for the nozzle. The receptacle includes a drain port on the lower end of the receptacle and a drain tube is attached to the drain port. A valve is plumbed into the receptacle. When residual fuel has accumulated in the receptacle, the end of the drain tube is fed into an appropriate holding vessel and the valve is opened to allow the residual fuel to drain from the receptacle into the holding vessel.

4 Claims, 6 Drawing Sheets

(56) References Cited

U.S. PATENT DOCUMENTS

| | | | | |
|---|---|---|---|---|
| 7,299,834 | B1 * | 11/2007 | Platt | B67C 11/04 141/301 |
| 8,578,976 | B1 * | 11/2013 | Davis | E03B 3/03 141/86 |
| 10,961,108 | B2 * | 3/2021 | Graef | B67D 7/16 |
| 2005/0224138 | A1 * | 10/2005 | Guthrie | F16L 11/18 141/340 |
| 2010/0084042 | A1 * | 4/2010 | Bonnell | B67C 9/00 141/1 |
| 2011/0204086 | A1 * | 8/2011 | Karam | B67D 7/56 222/25 |
| 2017/0355587 | A1 * | 12/2017 | Hinsey | B67D 7/04 |
| 2019/0284041 | A1 * | 9/2019 | Hattum | B60P 3/2265 |

* cited by examiner

DRAINABLE FUEL NOZZLE RECEPTACLE

TECHNICAL FIELD

The present invention relates to fuel nozzle receptacles, and more particularly, to a nozzle receptacle designed for use primarily with fuel nozzles used with transfer and auxiliary fuel tanks found in vehicles. The fuel nozzle receptacle according to the invention includes a drain opening in the lower end and a shut-off valve in the drain line.

BACKGROUND

Many trucks and other vehicles carry both auxiliary fuel tanks and transfer fuel tanks, usually for diesel fuel, but also for other types of fuel. The primary difference between a "transfer" tank and an "auxiliary" tank is that with a transfer tank the fuel must be pumped out of the tank, whereas with an auxiliary tank the fuel may be plumbed directly to the vehicle fuel system. Transfer tanks always have a fuel nozzle connected to a fuel hose that runs from the tank; auxiliary tanks often also have a fuel nozzle and hose. Herein, the term "auxiliary tank" refers to both conventional transfer tanks and auxiliary tanks that include a fuel hose and a fuel nozzle.

There are many different types of fuel nozzles that are used with auxiliary tanks, but generally speaking, such nozzles are automatic shut-off nozzles (to prevent overfilling and spillage). These types of fuel nozzles are familiar to most drivers because they are the kinds of nozzles found at nearly all fueling stations across the United States. At commercial fueling stations the fuel nozzles are conventionally stored in the fuel pumps with the nozzle received in a receptacle such that the nozzle is in a tip-up orientation. That is, the distal end of the nozzle (i.e., the end of the nozzle through which fuel flows) is oriented vertically above the nozzle. In this orientation any fuel remaining in the nozzle flows under gravity into the fuel hose. This prevents drippage and spills. Moreover, in order to help prevent spillage of fuel, the nozzles used in conventional fuel stations are generally high quality and have very efficient valves that shut off fuel flow when closed. And of course, nozzles at fuel stations are not subject to constant jostling and vibration that is present with fuel nozzles in vehicles.

However, in auxiliary tanks the nozzle is often received in a receptacle such that the nozzle is stored in a tip-down orientation. This orientation is convenient because it tends to be more stable when the vehicle is operated over rough surfaces, so the nozzle does not inadvertently become dislodged from the receptacle. However, after a fuel nozzle is used in an auxiliary tank there is always some residual amount of fuel in the nozzle and those portions of the hose that are positioned vertically above the nozzle. When the nozzle is stored in a tip-down orientation, the residual fuel drains into the receptacle. Even where the nozzle includes a good quality valve, fuel leakage out of the nozzle is nearly impossible to prevent given the jostling and vibration that occurs during movement of the vehicle. If the receptacle has an opening in the bottom, the residual fuel drains onto the truck bed. This creates a mess that needs to be cleaned in order to prevent dangerous conditions. Some types of conventional nozzle receptacles (sometimes called "holsters" or "boots) have a closed bottom so that residual fuels pool in the receptacles. An example of this later type of boot is shown in FIG. 1. That particular boot is removable from the mounting bracket so that when the receptacle is filling with fuel, it may be removed and emptied. But this is an undesirable situation since the fuel is typically contaminated (dirt, water, etc.) so that it cannot be transferred to the auxiliary tank and re-used. As such, the fuel from the receptacle must be transferred to a suitable environmentally appropriate container. Such a container may be difficult to find in the field. Moreover, when fuel accumulates in the receptacle the nozzle is always wet with fuel. When removed to transfer fuel using the nozzle, fuel drips off the nozzle onto the ground and other surfaces where it is not wanted.

Accordingly, there is a need therefore for a fuel nozzle receptacle that alleviates the problems associated with known receptacles, and which provides an environmentally sensitive manner of collecting residual fuel from an auxiliary tank, and which provides a secure location to store the fuel nozzle. The present invention defines a fuel nozzle receptacle for use with auxiliary tanks. The fuel nozzle is received in a receptacle in a nozzle-down orientation that defines a secure storage for the nozzle. The receptacle includes a drain port on the lower end of the receptacle and a drain tube is attached to the drain port. The receptacle includes a valve. When residual fuel has accumulated in the receptacle, the end of the drain tube is fed into an appropriate holding vessel and the valve is opened to allow the residual fuel to drain from the receptacle into the holding vessel.

The invention allows for environmentally safe collection of residual fuel and the elimination of spillage and messes in the truck bed. The invention described herein may be beneficially used with numerous types of vehicles and numerous other situations, ranging from pickup trucks and other trucks, commercial and agricultural equipment, and stationary fuel tanks

BRIEF DESCRIPTION OF THE DRAWINGS

The invention will be better understood, and its numerous objects and advantages will be apparent by reference to the following detailed description of the invention when taken in conjunction with the following drawings.

FIG. 5A is a side elevation and partial cross-sectional view of a fuel nozzle receptacle with a weather-proof enclosure according to the present invention, illustrating the fuel nozzle in the desired nozzle down orientation within the weather-proof enclosure.

FIG. 5B is a front elevation and partial cross-sectional view of a fuel nozzle receptacle according to the present invention, illustrating the components thereof.

FIG. 5C is a perspective view of the fuel nozzle receptacle illustrated in FIG. 5B, and including a sight glass.

DETAILED DESCRIPTION OF ILLUSTRATED EMBODIMENTS

The invention will now be described in detail with reference to the drawings. Directional terms used herein correspond to the convention wherein, for instance: "upper" refers to the direction above and away from a ground plane; "lower" is generally in the opposite direction, "inward" is the direction from the exterior toward the interior of the component, "vertical" is the direction normal to a horizontal ground plane, and so on.

Figure 1A:
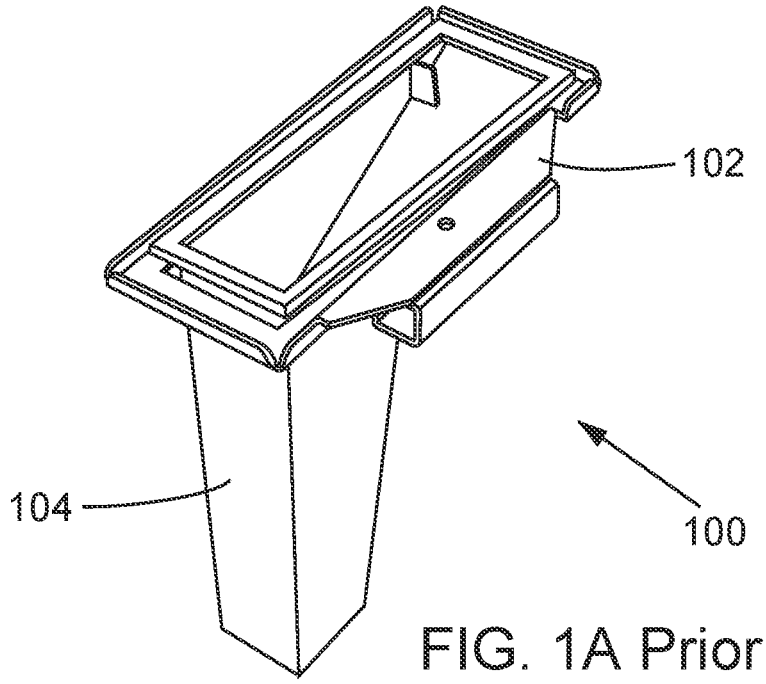
FIG. 1A Prior Art
FIG. 1A is an upper perspective view of a prior art fuel nozzle receptacle that is adapted to receive a nozzle in a tip-down (also referred to herein as "nozzle down" orientation).
Figure 1B:
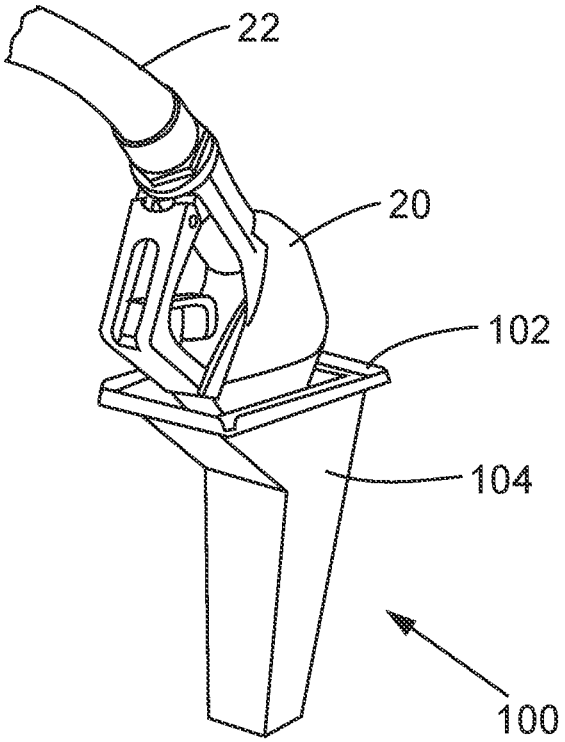
FIG. 1B Prior Art
FIG. 1B is an upper perspective view of the prior art fuel nozzle receptacle shown in FIG. 1 with a fuel nozzle received in the receptacle, and wherein the fuel nozzle is in the nozzle down orientation.

A prior art fuel nozzle receptacle 100 is shown in FIGS. 1A and 1B. The receptacle 100 includes a mounting bracket 102 that extends around the upper periphery of the boot 104 and which allows the receptacle 100 to be mounted to any convenient location, for instance, in the bed of a pickup truck adjacent to an auxiliary fuel tank, or to the auxiliary fuel tank itself. The boot 104 is a closed vessel. In other words, there is no drain port in the boot. As seen in FIG. 1B, the fuel nozzle 20 is received in the boot 104 in a nozzle-down orientation. With this receptacle 100, residual fuel drains under gravity into the boot 104. When enough fuel has drained into the boot that the boot needs to be emptied, the boot may be removed from the bracket to allow the residual fuel to be dumped into an appropriate container.

Figure 2:
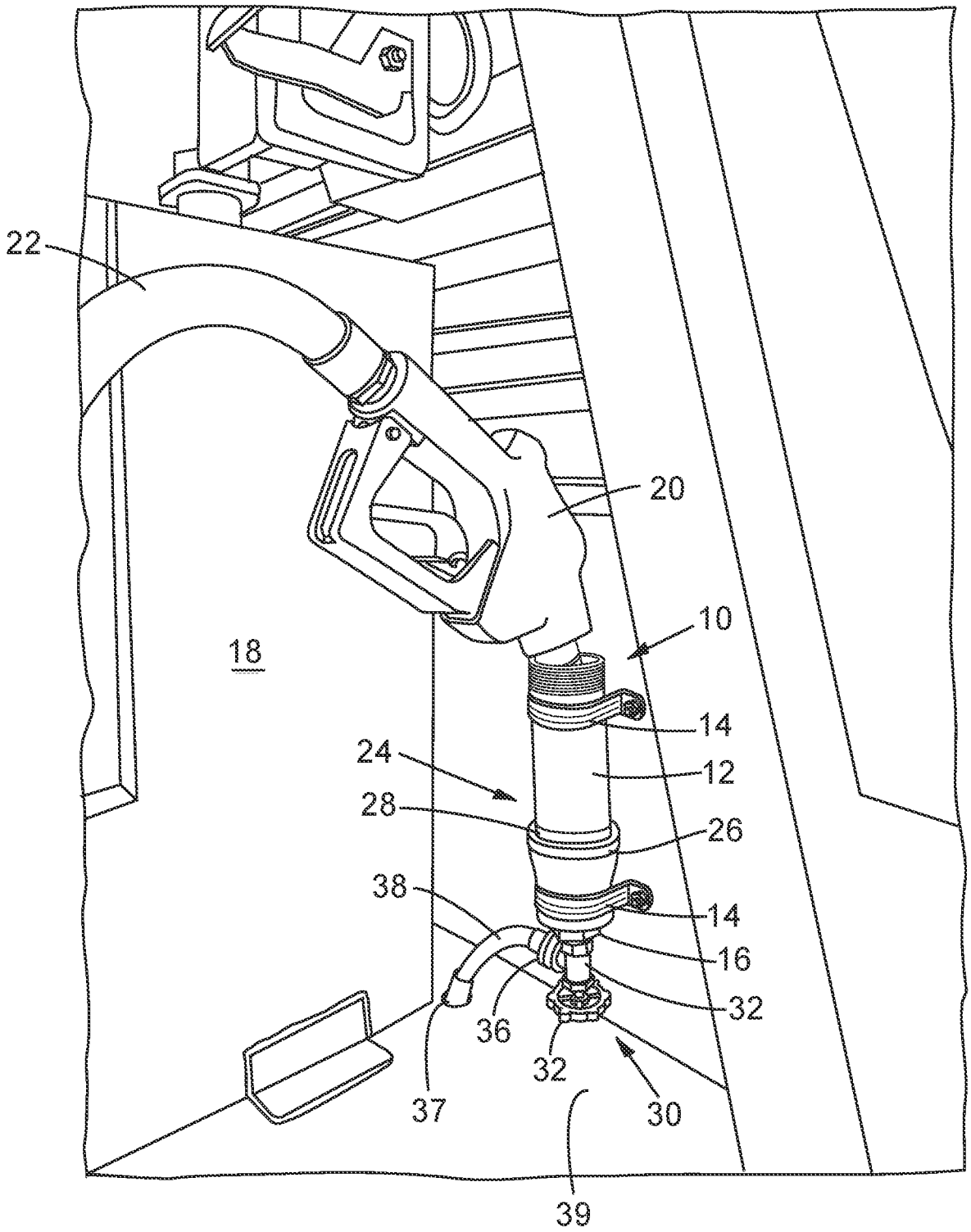
FIG. 2 is a perspective view of a first illustrated embodiment of a fuel nozzle receptacle according to the present invention, shown mounted in a pickup truck bed adjacent to an auxiliary fuel tank.

A first illustrated embodiment of a fuel nozzle receptacle 10 according to the present invention is shown in FIG. 2. The receptacle 10 is defined by a boot 12 that is mounted vertically with brackets 14 at a convenient location. In FIG. 2 the boot 12 is mounted to a bulkhead 16 of a pickup flatbed so that the receptacle 10 is located adjacent the auxiliary fuel tank 18. The boot 12 is mounted in a vertical orientation so that the fuel nozzle 20 is received in the boot 12 in a nozzle-down orientation—that is, the distal end of the nozzle is positioned interiorly in the boot when in the storage position shown in FIG. 2. Fuel is fed to the nozzle 20 through a fuel hose 22, which in turn is fluidly connected to the auxiliary fuel tank 18. The tank 18, hose 22, and nozzle 20 are all conventional. In the embodiment shown in FIG. 2, the boot 12 is a cylindrical length of steel pipe such as galvanized steel that has a threaded lower end 24 onto which a threaded galvanized reducing coupling 26 is threaded. Appropriate thread sealing tape 28 for use in an environment with petrochemicals is used to insure against leaks A drain assembly 30 is threaded onto the outlet 32 from the reducing coupling 26. The drain assembly 30 includes a valve 34 and an outlet 36 to which a drain hose or tube 38 is connected.

Figure 6:
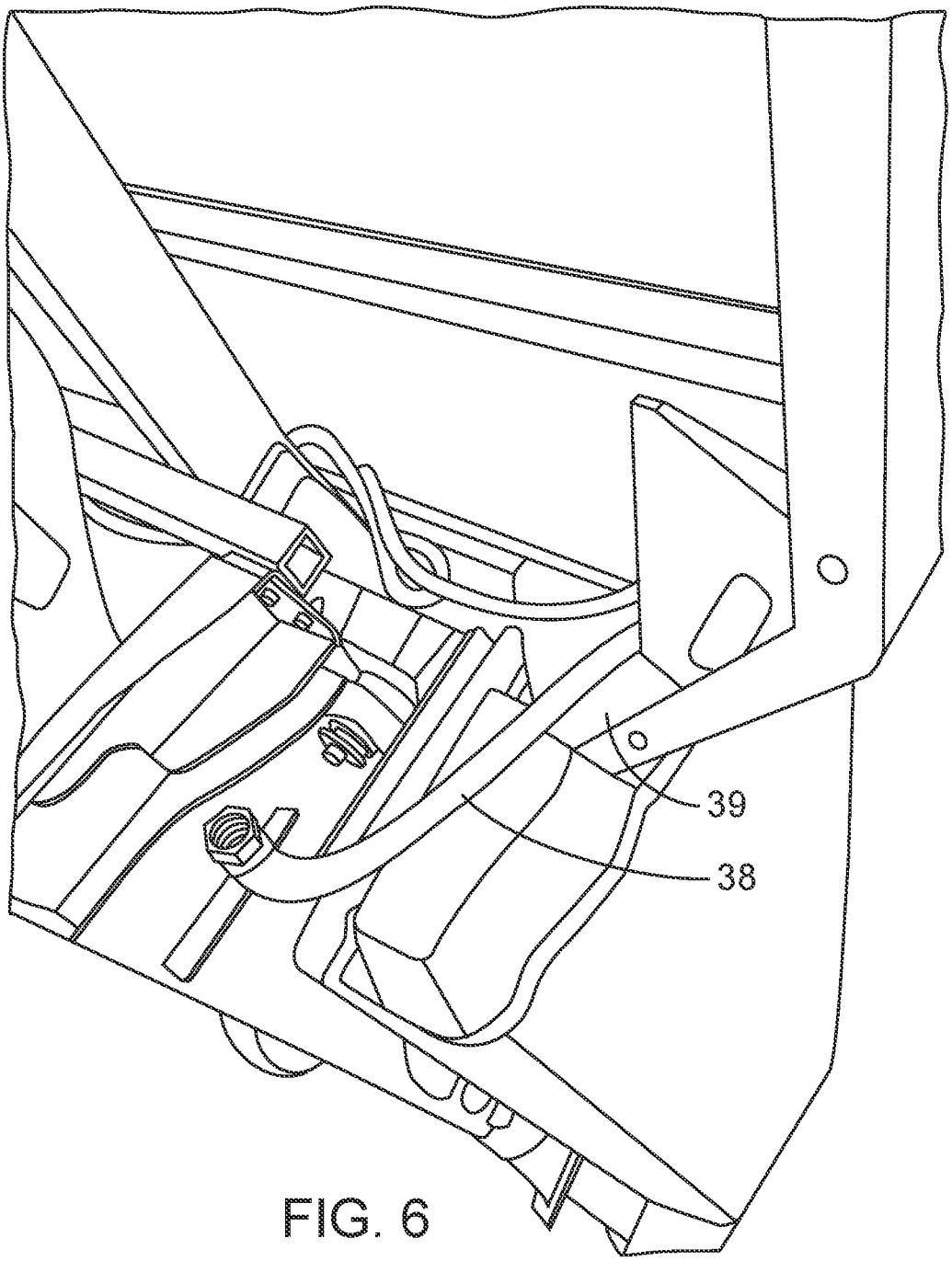
FIG. 6 is a lower perspective view of the underside of a pickup truck bed to illustrate the distal end of a drain line extending from the fuel nozzle receptacle according to the invention to the space below the pickup truck bed.

It will be appreciated that the components of the receptacle 10 may be fabricated from any material appropriate for use with petrochemicals, including metals, plastics and the like, which are not degradable by petrochemicals. Moreover, the components such as the boot 12 and the reducing coupling 26 may be fabricated in a unitary module that includes fittings for installation of a valve 32 and an outlet 34. The valve 32 may be of any appropriate type, including the gate valves 32 shown in FIGS. 2 and 3, and ball valves and the like. The drain tube must of course be of a material appropriate for use with petrochemicals and is beneficially flexible so that it may be led through a hole 37 formed in the floor 39 of the pickup truck bed. With reference to FIG. 6, the drain tube 38 preferably extends through the floor 39 of the pickup bed and terminates beneath the floor. An optional cap may be fitted to the terminal end of the drain tube 38 to prevent dripping. Alternately, to avoid drilling a hole through the bed of the pickup truck, the drain tube may be coiled and stored below the receptacle 10 inside of the pickup bed.

Figure 3:
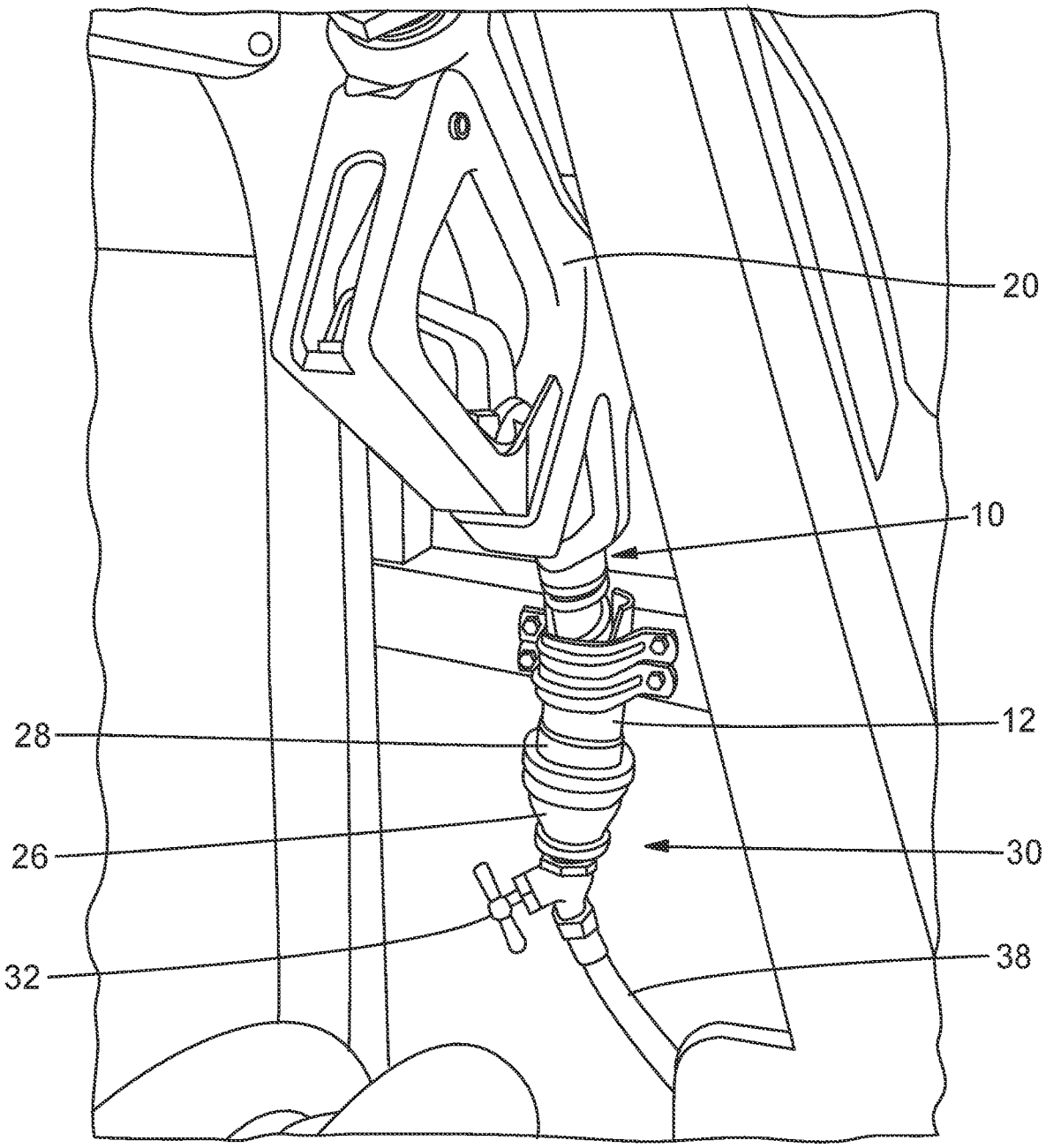
FIG. 3 is a perspective view of a second illustrated embodiment of a fuel nozzle receptacle according to the present invention, shown mounted in a pickup truck bed adjacent to an auxiliary fuel tank.
Figure 4:
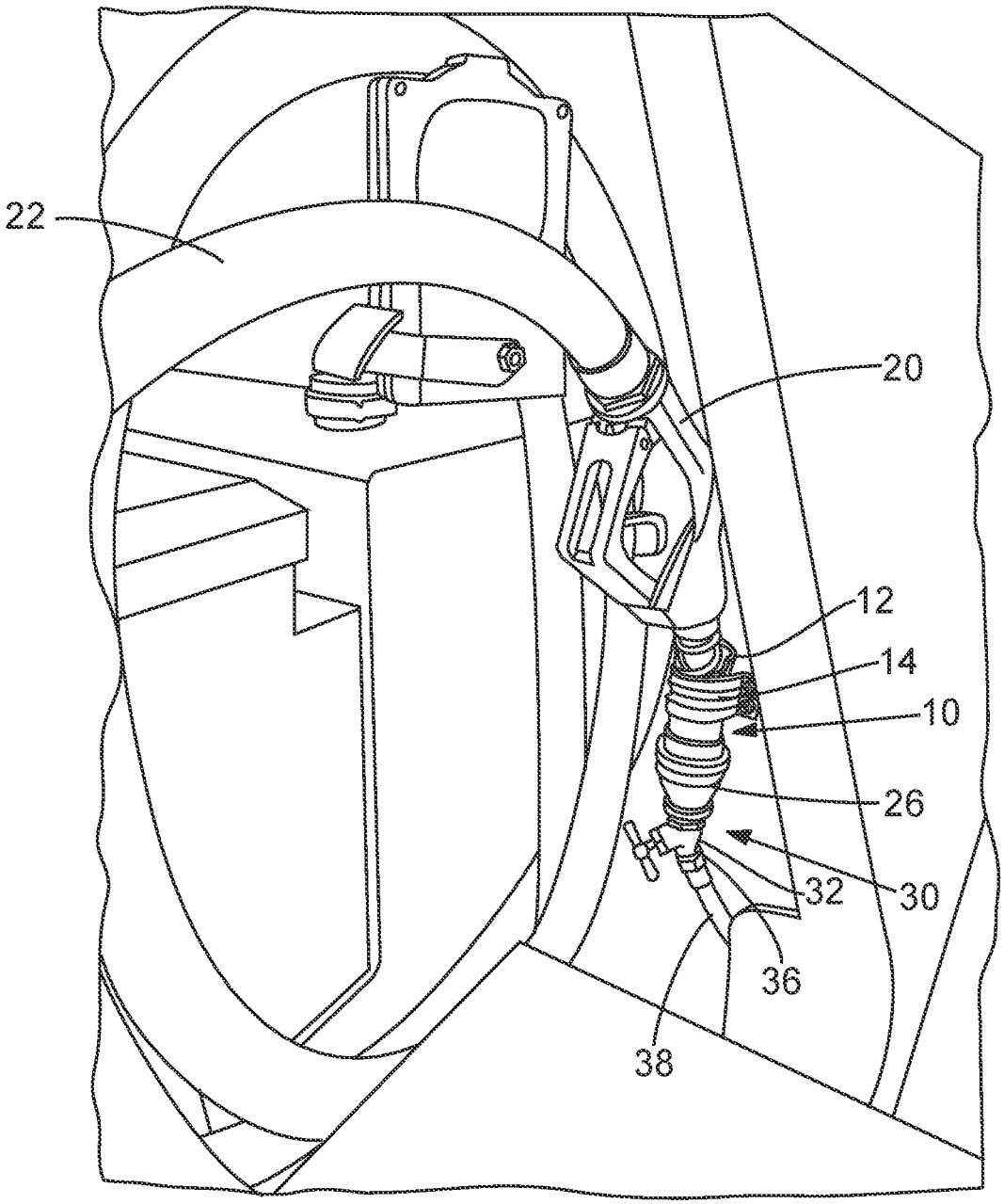
FIG. 4 is a perspective view of a third illustrated embodiment of a fuel nozzle receptacle according to the present invention, shown mounted in a pickup truck bed adjacent to an auxiliary fuel tank.

Turning now to FIGS. 3 and 4, a threaded reducing coupling 26 is screwed onto the lower end of the boot 12 and a conventional rotary hose bib is used to define the valve 32 of drain assembly 30.

Figure 5A:
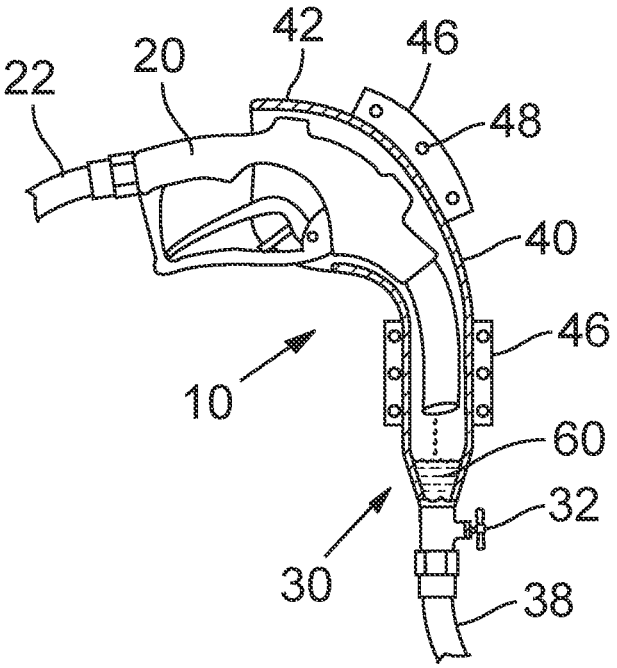
FIGS. 5A, 5B and 5C are a series of alternative embodiments of fuel nozzle receptacles according to the present invention. Specifically.
Figure 5B:
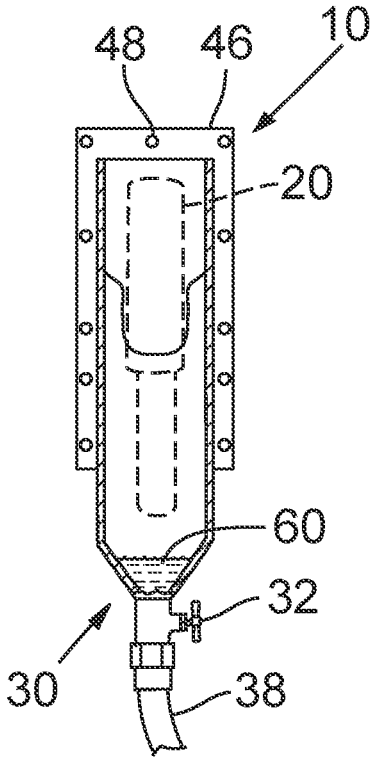
Figure 5C:
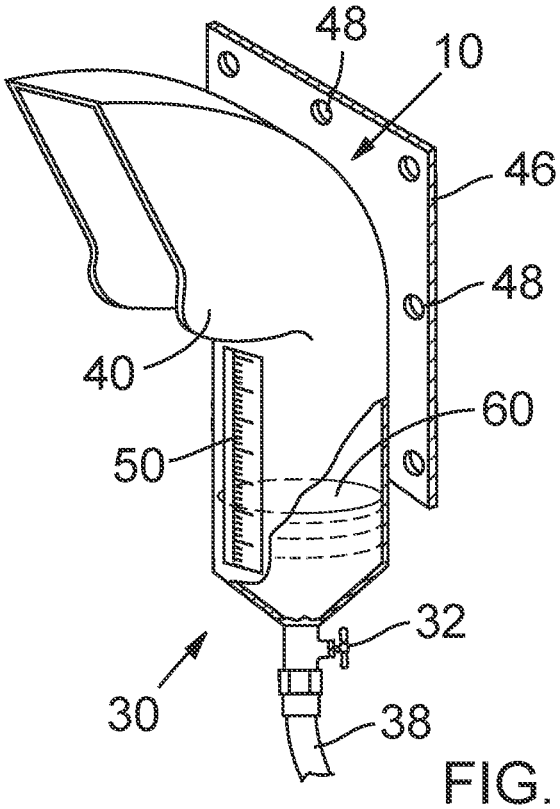

It will further be appreciated that the configuration of the boot 12 may be varied according to need and circumstance from that shown in FIGS. 2 and 3. For example, in FIG. 5 various alternative embodiments are illustrated. In FIG. 5A, a cross sectional view of a fuel nozzle receptacle 10 is shown. There, the boot 40 includes an overhead cowling portion 42 that covers the nozzle 20 when the nozzle is received in the boot 40 in the storage position, which is shown. The cowling portion 42 provides a weather-proof enclosure that prevents water and other contaminants from entering the boot 40. As such, when residual fuel 60 is drained from the boot 40 via drain assembly 30, the residual fuel 60 may be re-used because it will not be contaminated with water. The boots 40 in FIGS. 5A, 5B and 5C include integral or attached brackets 46 that include plural bores 48 that allow the receptacle 10 to be mounted at a convenient location such as the auxiliary tank or a bulkhead in the truck. The bracket s 46 shown in the embodiment of FIG. 5A is a two-piece bracket, whereas the bracket 46 used with the embodiment of FIGS. 5B and 5C is a one-piece bracket. Of course, the design of the bracket may vary widely according to need. With each of the embodiments of FIGS. 5A, 5B and 5C, the receptacle 10 may be mounted with screws extending through the bores, or with quick-release type fittings such as locking pins and the like.

With reference to FIG. 5C, the boot 40 may include a graduated sight glass 50 so that the level of residual fuel that has accumulated in the boot 40 may be determined quickly.

Those of skill in the art will understand that the fuel nozzle 10 described herein creates a flow path for residual fuel that flows or drains from the nozzle 20, the flow path running from the nozzle 20 to the boot 12, through a drain opening at the lower end of the boot and into a valve assembly, and from the valve assembly through a drain tube. The lower, or distal end 24 of the boot 12 defines a catchment basin or reservoir for accumulating fuel that drains from the nozzle 20. When an operator observes that fuel that has accumulated in the reservoir needs to be drained, the drain tube 38 is inserted into an appropriate container and the valve 32 is opened so that the fuel accumulated in the reservoir drains into the container. The valve assembly includes a selectively openable and closable valve—when the valve is open the fluid path is open so that residual fuel that has accumulated in the reservoir in the boot 12 flows out of the drain tube into a collector vessel; when the valve is closed the fluid path is closes so that residual fuel accumulates in the boot.

The fuel nozzle 10 described herein may be used in numerous types of vehicles and numerous other situations, ranging from pickup trucks and other trucks, emergency vehicles and agricultural equipment and stationary fuel tanks.

While the present invention has been described in terms of preferred and illustrated embodiments, it will be appreciated by those of ordinary skill that the spirit and scope of the invention is not limited to those embodiments, but extend to the various modifications and equivalents as defined in the appended claims.

The invention claimed is:

1. An auxiliary fuel system, comprising:

an auxiliary fuel tank comprising a fuel hose that fluidly connects to a fuel nozzle having a handle and a trigger at a proximal end near the fuel hose and an opening tip at a distal end configured to release fuel;

a fuel nozzle receptacle configured and positioned in sufficient proximity to the auxiliary fuel tank for receiving the fuel nozzle in a tip down orientation, the fuel nozzle receptacle having an open upper end, a closed lower end that defines a reservoir for holding residual fuel with a drain port extending through the closed lower end, wherein the fuel nozzle receptacle has a sight glass configured to allow a user to view the reservoir, and the fuel nozzle receptacle is configured such that when the fuel nozzle is received within, the opening tip of the fuel nozzle does not abut against the closed lower end of the fuel nozzle receptacle and is not otherwise positioned within the reservoir such that accumulated residual fuel can contact the opening tip-;

a selectively openable valve in the drain port;

further comprising a drain hose having a near end attached to the drain port, and a terminal end; and wherein the auxiliary fuel tank and the fuel nozzle receptacle are positioned in a truck bed on a truck.

2. The auxiliary fuel system according to claim 1 further comprising a cowling extending over the open upper end to define a partial covering that only covers a portion of the fuel nozzle while the fuel nozzle is positioned in the fuel nozzle receptacle in a tip down orientation.

3. The auxiliary fuel system according to claim 1, wherein the opening tip at the distal end of the fuel nozzle is vertically aligned directly above the drain port when the fuel nozzle is received by the fuel nozzle receptacle.

4. The auxiliary fuel system according to claim 2, wherein the opening tip at the distal end of the fuel nozzle is vertically aligned directly above the drain port when the fuel nozzle is received by the fuel nozzle receptacle.

* * * * *